US006786780B2

(12) United States Patent
Moriai

(10) Patent No.: US 6,786,780 B2
(45) Date of Patent: Sep. 7, 2004

(54) CONNECTOR DEVICE AND DRIVE DEVICE USING CONNECTOR DEVICE

(75) Inventor: Takakatsu Moriai, Honjo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/210,072

(22) Filed: Aug. 2, 2002

(65) Prior Publication Data

US 2003/0077949 A1 Apr. 24, 2003

(30) Foreign Application Priority Data

Oct. 22, 2001 (JP) ..... 2001-323838

(51) Int. Cl.[7] ..... H01R 13/40

(52) U.S. Cl. ..... 439/733.1; 439/541.5; 439/260; 439/630

(58) Field of Search ..... 439/733.1, 541.5, 439/629–630, 260

(56) References Cited

U.S. PATENT DOCUMENTS 5,401,186 A * 3/1995 Nozaki et al. ..... 439/495
5,498,169 A * 3/1996 Ikemoto ..... 439/260
6,464,521 B1 * 10/2002 Kurotori et al. ..... 439/260

FOREIGN PATENT DOCUMENTS

| | | |
|---|---|---|
| JP | 2-123081 | 10/1990 |
| JP | 7210878 | 8/1995 |
| JP | 10083847 | 3/1998 |

OTHER PUBLICATIONS

Japanese Office Action dated Mar. 24, 2004 in JP–2001–323838 on which the instrant application relies for priority (and English Translation of Same).

* cited by examiner

*Primary Examiner*—Truc Nguyen
(74) *Attorney, Agent, or Firm*—Pillsbury Winthrop LLP

(57) ABSTRACT

A connector device has connection terminals set in a connector body, each having a contact section formed for inspection. Further, a drive device is such that the connector device is attached to a printed circuit board having a circuit unit configured to control an object to be controlled.

14 Claims, 5 Drawing Sheets

CONNECTOR DEVICE AND DRIVE DEVICE USING CONNECTOR DEVICE

CROSS-REFERENCE TO RELATED APPLICATIONS

This application is based upon and claims the benefit of priority from the prior Japanese Patent Application No. 2001-323838, filed Oct. 22, 2001, the entire contents of which are incorporated herein by reference.

BACKGROUND OF THE INVENTION

1. Field of the Invention

The present invention relates to a connector device suitable for the operation testing of circuit units formed on a printed circuit board and to a drive device using the connector device.

2. Description of the Related Art

As is well known in this field, for example, a disk drive device such as a DVD-ROM (Digital Versatile Disk-Read Only Memory) drive includes a plurality of printed circuit boards having circuit units configured to control a disk motor, optical pickup, and so on, as well as a main circuit unit, etc., configured to control these circuit units in an integrating fashion.

This kind of disk drive device is such that respective external connection connectors are attached to a plurality of built-in printed circuit boards and these connectors are connected together through a connection board such as an FPC (flexible printed circuit) or FFC (flexible flat cable) whereby the respective printed circuit boards are electrically connected to each other.

Incidentally, in the case where an operation test is conducted on the respective circuit units formed on a plurality of printed circuit boards in such a disk drive device, the usual practice is to connect an FPC or FFC for checking to the connector attached to the printed circuit board and to perform operation checking by supplying a power source output, various kinds of checking signals and so on.

In the operation testing method of the above-mentioned circuit units, however, the FPC or FFC for checking is connected to the connectors on the printed circuit board by an inserting operation and, by doing so, the operation testing is conducted. After this, the FPC or FFC is withdrawn from the connector. For this reason, the FPC or FFC for checking needs to be periodically exchanged since the insertion/withdrawing operation is repeatedly done relative to the connectors.

When the FPC or FFC is worn out, the adhesive used on the lining side is partially displaced to the outside and deposited on the contact pins, thus causing a contact failure. Further, the forward end portions of the contact pins are made sharper to some extent to ensure good contact with the FPC or FFC but, if the forward end portions of the contact pins are rounded due to the repeated insertion and withdrawing operations of the FPC or FFC, initial contact stability is impaired.

Further, the FPC or FFC is usually solder-plated at that portion of contacting with its connector. If, therefore, the FPC or FFC is inserted into and withdrawn from the connector, its surface is scraped by the forward ends of the contact pins to produce metal hairs and the metal hairs are left inside the connector. And there are sometimes cases that such metal hairs are spanned between and among a plurality of contact pins to produce short-circuit.

Further, the FPC or FFC is inserted into the connector in a state in which a lock slider provided on the connector side is moved in an unlocking direction and then it is fixed to the connector by moving the lock slider to a locking position. In the method for repeating the inserting and withdrawing of the FPC or FFC into and out of the connector, therefore, the operation of the lock slider is cumbersome and it may also involve breakage.

There is also a method of performing operation testing on circuit units on the printed circuit board without connecting the FPC or FFC for checking to the connector. This method comprises forming testing lands on a printed circuit board which are connected to contact pins of the connector and supplying a power source output, various kinds of testing signals and so on, in a state in which a pin fixture for checking is contacted with the testing lands.

In the method for forming such testing lands on the printed circuit board, however, it is necessary to provide an area for forming a plurality of testing lands on the printed circuit board so that the mounting area of component parts is restricted. Further, since the testing operation is done with the pin fixture set in contact with the testing lands, there arises the problem that it is not possible to detect soldering failure between the terminal of the connector and the circuit patterns on the printed circuit board.

BRIEF SUMMARY OF THE INVENTION

It is accordingly the object of the present invention to provide a connector device and a drive device using the connector device which can easily and highly accurately realize operation testing of circuit units formed on a printed circuit board by solving various problems involved in the connection of an FPC or FFC for checking, the formation of testing lands on a printed circuit board, and so on.

According to one aspect of the present invention there is provided a connector device comprising a connector body and a plurality of connection terminals set in the connector body, having contact sections for testing.

According to another aspect of the present invention there is provided a device comprising a case, a printed circuit board set in the case and a connector device comprising a connector body attached to the printed circuit board and connection terminals, set in the connector body, having a contact section formed for inspection.

DETAILED DESCRIPTION OF THE INVENTION

Figure 1:
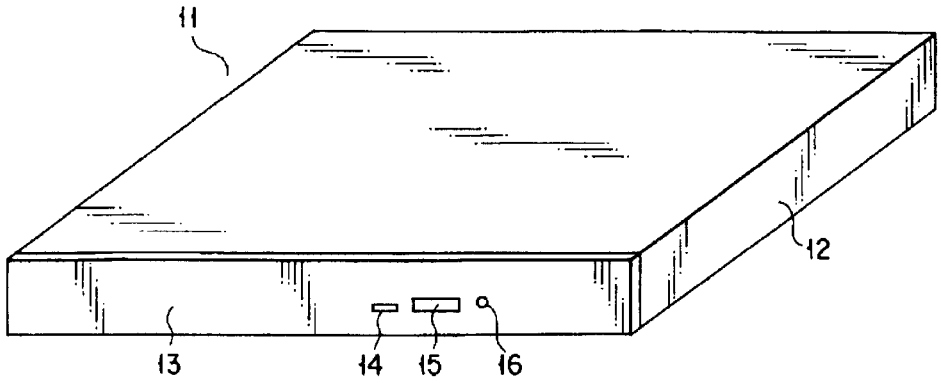
FIG. 1 is a view showing an outer appearance for explaining a disk drive device according to one embodiment of the present invention.

One embodiment of the present invention will be described in more detail below with reference to the accompanying drawing. FIG. 1 shows an outer appearance of a disk drive device 11 explained in connection with the present embodiment. This disk drive device 11 has a body section 12 formed in a substantially thin type box-like shape and has the function of reading out stored data from a read-only optical disk, such as a DVD-ROM.

A panel 13 is exposed at one side surface of the body section 12. This panel 13 has an indicator 14, a release switch 15 and a release hole 16. Of these, the indicator 14 is lit with a lighting pattern corresponding to the state of reading out the stored data from the optical disk held in place in the body section 12 and is turned off when it is in a normally stopped state.

Figure 2:
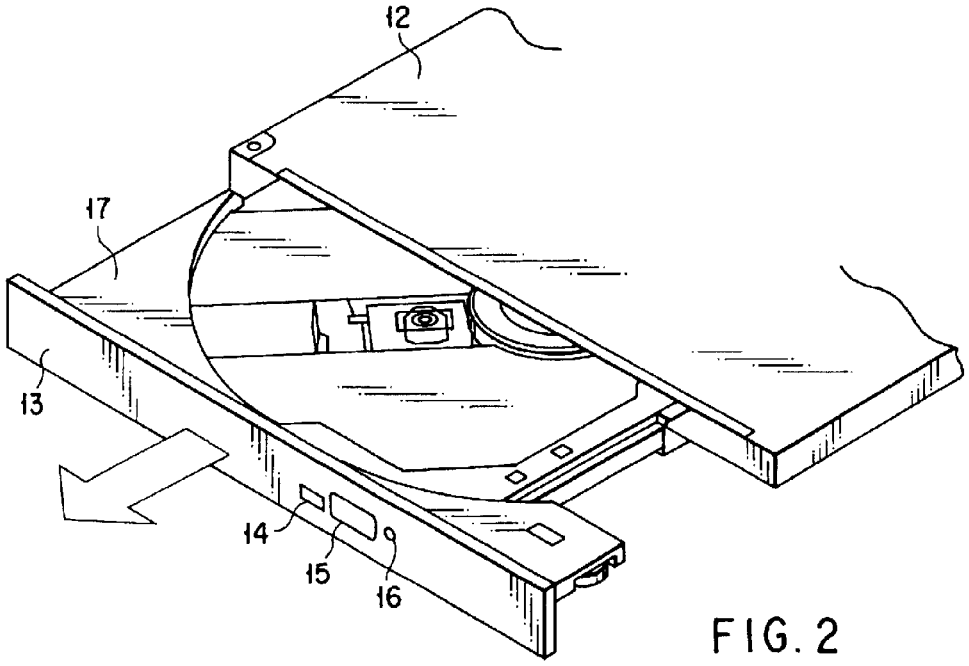
FIG. 2 is a perspective view for explaining a structure with a disk tray section withdrawn from a body section in the embodiment of the present invention.

The release switch 15 has the function of, upon being operated, automatically drawing a disk tray section 17 out of the body section 12 as is indicated by the arrow in FIG. 2. It is to be noted that the disk tray section 17 is manually pushed into the body section 12 from a drawn-out state and locked in place.

The release hole 16 has a tray release lever, not shown, which is set therein. By inserting a metal rod, etc., not shown, into the release hole 16 and operating the above-mentioned tray release lever it is possible to manually draw the disk tray section 17 out of the body section 12 and push it into the body section 12.

Figure 3:
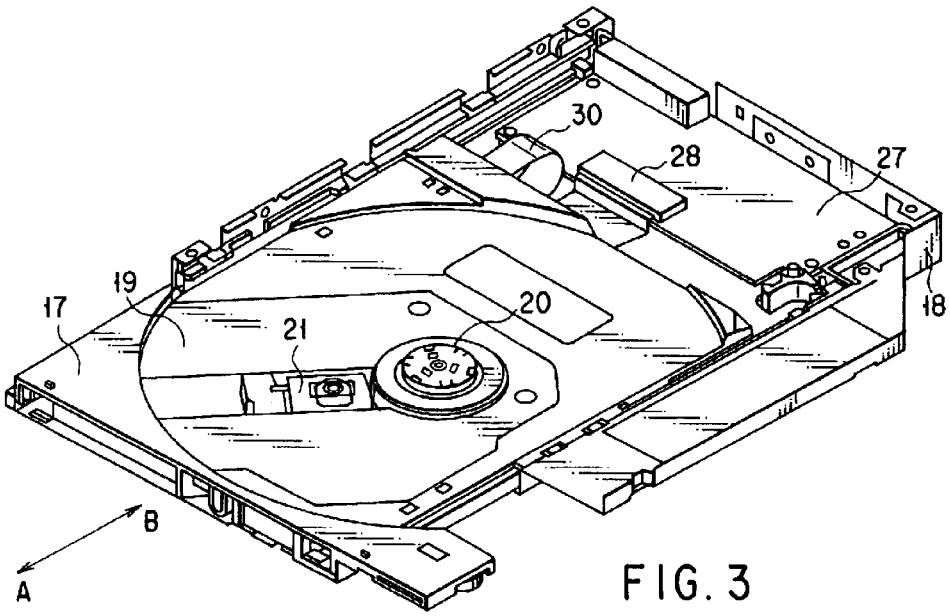
FIG. 3 is a perspective view for explaining a detailed structure and operation of the disk tray in the embodiment of the present invention.

As shown in FIG. 3, the disk tray section 17 is so supported as to be slidable in those directions of arrows A, B relative to a main frame 18 fixed in place in the body section 12. And the disk tray section 17 is drawn out of the body section 12 under the action of a solenoid, not shown, which is driven by the operation of the release switch 15.

A disk rest section 19 is provided with the optical disk settable on the disk tray section 17. A motor 20 is arranged at a center position of the disk rest section 19 in the disk tray section 17.

Further, an optical pickup 21 is arranged at the disk tray section 17 to move over the optical disk which is place on the disk rest section 19 in a radial direction of the optical disk. The optical pickup 21 is moved by a pickup feeding motor, not shown, in the radial direction of the optical disk.

Figure 4:
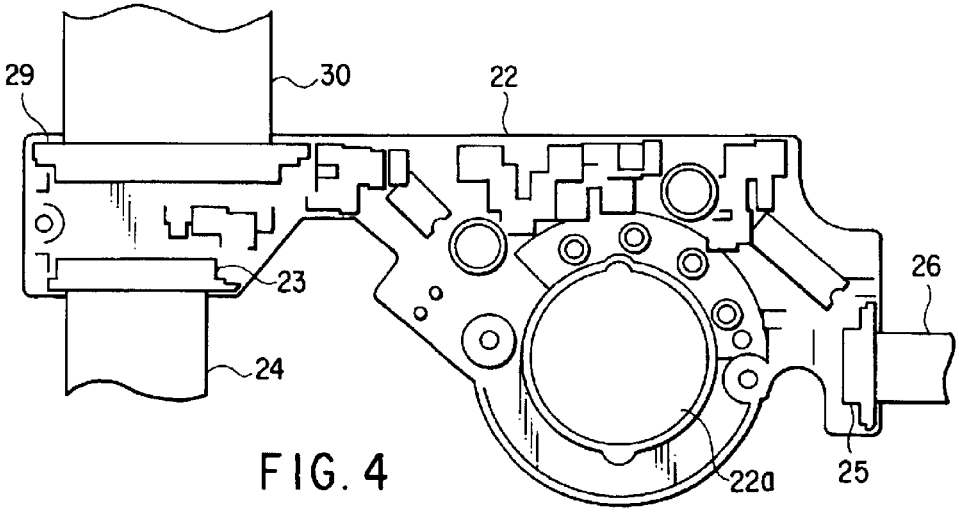
FIG. 4 is a view showing a detailed structure of a printed circuit board with various kinds of circuit units formed thereon in the embodiment of the present invention.

A printed circuit board 22 is arranged in the disk tray section 17 as shown in FIG. 4. Various kinds of circuit units are provided on the printed circuit board 22 so as to control the disk motor 20, optical pickup 21, pickup feeding motor, and so on.

The printed circuit board 22 is so formed as to have the disk motor 20 in its area 22*a* and controls the disk motor 20. Further, the printed circuit board 22 controls the optical pickup 21 through an FPC 24 connected to a connector 23 and controls the pickup feeding motor through an FPC 26 connected to a connector 25.

As shown again in FIG. 3, a printed circuit board 27 is provided on the main frame 18 and has a main circuit unit configured to control the disk drive device 11 in an integrated fashion. A connector 28 attached to the printed circuit board 27 is connected by an FPC 30 to a connector 29 attached to the printed circuit board 22.

The printed circuit board 27 controls the above-mentioned solenoid for allowing the disk tray section 17 to be release-driven relative to the body section 12.

Figure 5:
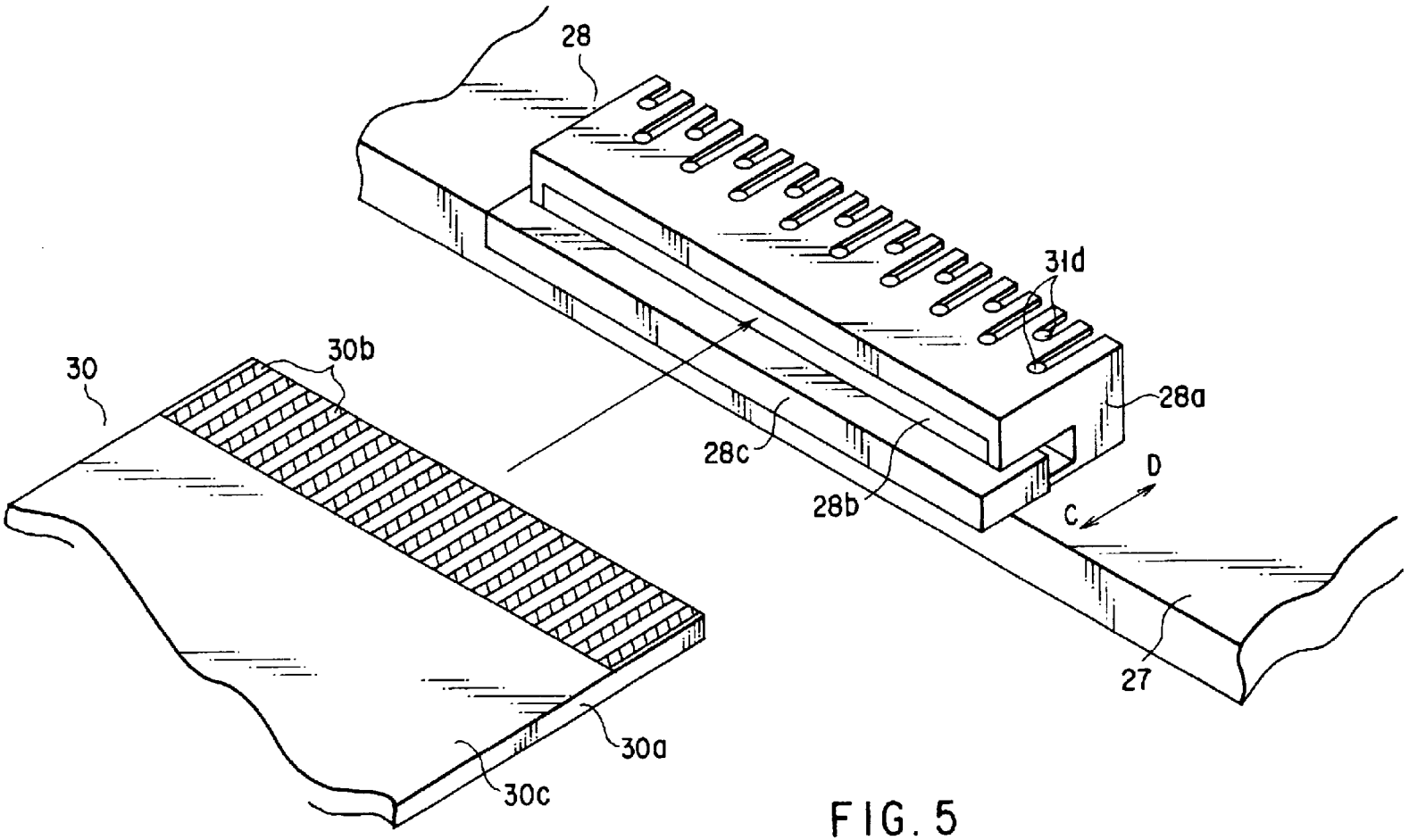
FIG. 5 is a perspective view showing a detail of a connector of the embodiment and an associated FPC connected to the connector.

FIG. 5 shows, in detail, the connector 28 attached to the printed circuit board 27, noting that the other connectors 23, 25 and 29 are the same in structure as the connector 28 and further explanation is, therefore, omitted.

That is, the connector 28 has a connector body 28*a* made of a synthetic resin material and formed in a substantially thin type box-like shape and one flat surface of the connector body 28*a* is attached to the end edge portion of the printed circuit board 27 in a manner to make contact with one surface of the printed circuit board 27.

An insertion slot 28*b* is provided in the connector body 28*a* on a side corresponding to the end edge portion of the printed circuit board 27 to allow one end edge portion of the FPC 30 to be inserted therein. Further, a lock slider 28*c* is provided relative to the connector body 28*a* to lock a portion of the insertion slot 28*b* in a longitudinal direction.

The lock slider 28*c* is so supported as to be movable in those directions of arrows C, D relative to the connector body 28*a*. The lock slider 28*c* can be set to an unlocking position in which it is moved in the direction of arrow C and to a locking position in which it is moved in the direction of arrow D.

When the FPC 30 is to be connected to the connector 28, first the lock slider 28*c* is moved in the direction of arrow C to the unlocking position. In this position, one end portion of the FPC 30 is inserted into the insertion slot 28*b* and the lock slider 28*c* is moved in the direction of arrow D to the locking position. By doing so, the FPC 30 is electrically and mechanically connected to the connector 28.

The FPC 30 comprises a substantially band-like flexible substrate 30*a* made of, for example, a polyimide-based resin material, a plurality of conductive patterns 30*b* formed side by side by etching a copper foil in its longitudinal direction on one surface of the flexible substrate 30*a*, and a cover layer 30 formed over the conductive patterns with an end portion of the FPC 30 removed to expose the conductive patterns 30*b*.

Figure 6:
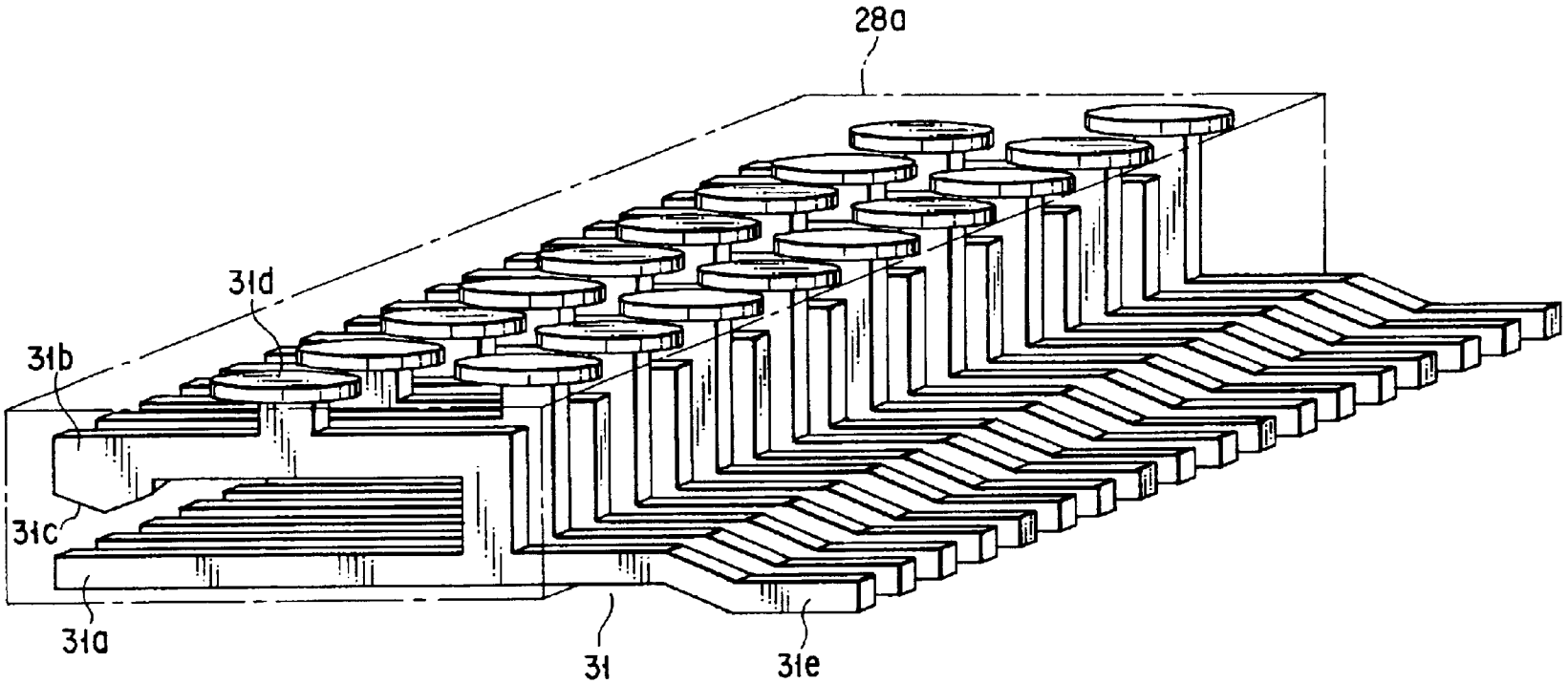
FIG. 6 is a perspective view for explaining a detailed structure of contact pins in the connector in the embodiment of the present invention.

Here, as shown in FIG. 6, a plurality of contact pins 31 are arranged side by side in the connector body 28*a*. Each contact pin 31 is made of a conductive material, is formed in an elongated thin sheet-like configuration and has a sandwiching section 31*a* at one end to allow the FPC 30 which is inserted into the connector body 28*a* via the insertion slot 28*b* to be sandwiched in a thickness direction.

One arm section 31*b* of the sandwiching section 31*a* has a contact section 31*c* with its sharp forward end portion settable in contact with the corresponding conductive pattern 30*b* exposed at the end portion of the FPC 30. A land section 31*d* for contact testing is formed integral with the arm section 31*b*.

An electrode section 31*e* is provided on the other end side of the contact pin 31 to be connected to a conductive pattern, not shown, formed on the printed circuit board 27.

Figure 7:
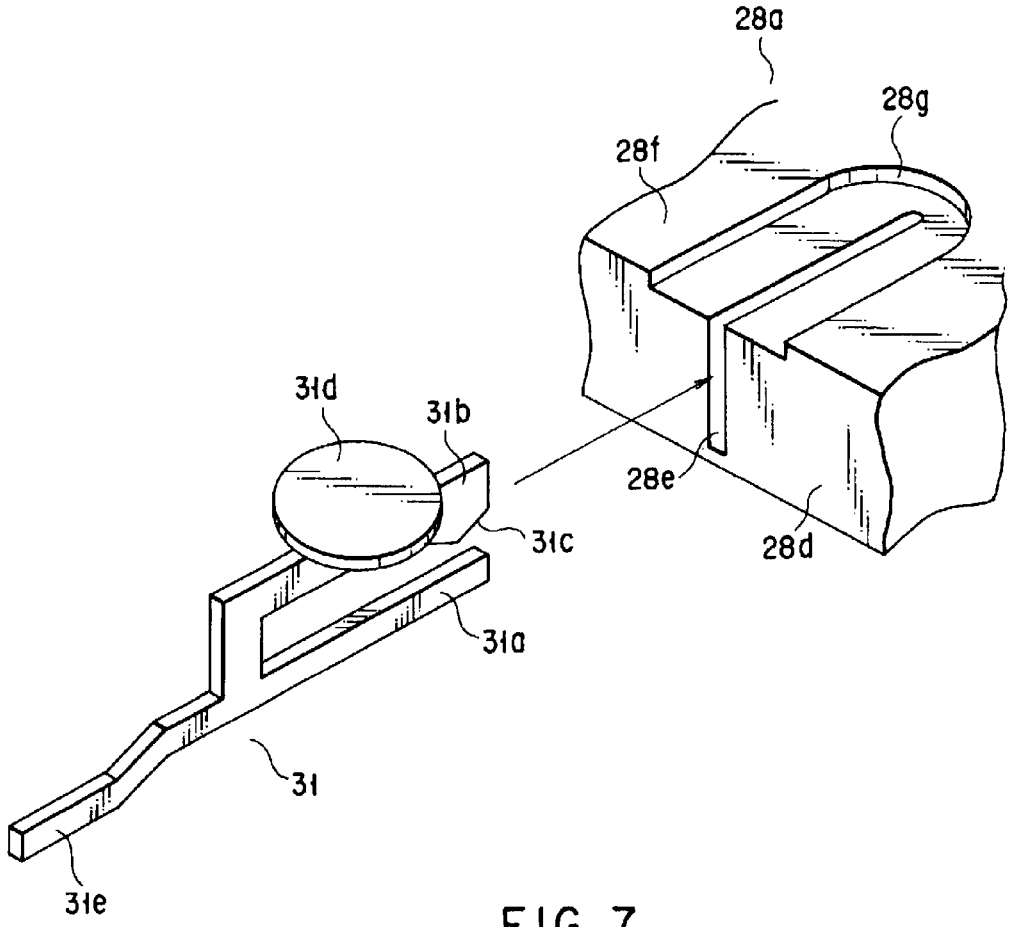
FIG. 7 is a perspective view for explaining the setting of a contact pin in the connector in the embodiment of the present invention.

Here, as shown in FIG. 7, on a face 28*d* opposite to a face formed with the insertion slot 28*b* of the connector body 28*a*, a plurality of support grooves 28*e* (one support groove is shown) are formed in a side-by-side array to allow corresponding contact pins 31 to be inserted therein and fixed in place. Each contact pin 31 is attached to the connector body 28*a* by being inserted into a corresponding support groove 28*e* from that side where the sandwiching section 31*a* is provided.

In a surface 28*f* of the connector body 28*a* opposite to the surface making contact with the printed circuit board 27 a recess 28*g* is provided for allowing a corresponding land section 31*d* to be guided therein when each contact pin 31 is inserted into the support groove 28*e*, and allowing the land section 31*d* to be stably supported with the land section 31*d* exposed after the contact pin 31 has been inserted into the support groove 28*e*.

In this way, the contact pins 31 are attached to the connector body 28*a* such that, as shown again in FIG. 5, the land sections 31*d* of these contact pins 31 are alternately staggered in a side-by-side array direction.

In the case where the circuit unit on the printed circuit board 27 is tested for its operation, a pin fixture for inspection is contacted with each land section 31*d* exposed from the connector 28 and operation checking can be done by supplying a power supply output and each kind of inspection signal and so on.

According to the above-mentioned embodiment, the land section 31*d* for inspection is provided on each contact pin 31 in the connector 28 and the pin fixture for inspection is set in contact with the land section 31*d*. This eliminates various problems caused by the connection of the FPC or FFC for inspection, the formation of testing lands on the printed circuit board, etc. It is, therefore, possible to easily and highly accurately test the circuit units of the printed circuit board for their operation.

What is claimed is:

1. A connector device comprising:

a connector body having a support groove; and a connection terminal which is made of a thin plate insertable in the support groove of the connector body, and which includes a contact section for inspection, the contact section having a flat surface larger than the connection terminal and expanding in a thickness direction of the connection terminal.

2. A connector device according to claim 1, wherein the contact section is exposed at the outside of the connector body in a state in which the connection terminal is set in the connector body.

3. A connector device according to claim 1, wherein the connection terminal has a sandwiching section configured to sandwich a connection board in a thickness direction when the connection board is inserted into the connector body, the contact section being formed on one arm section of the sandwiching section.

4. A connector device comprising:

a connector body having support grooves; and connection terminals which are made of thin plates insertable in the support grooves of the connector body and which each includes a contact section for inspection, the contact section having a flat surface larger than the connection terminal and expanding in a thickness direction of the connection terminal.

5. A connector device according to claim 4, wherein, in a state in which the connection terminals are set in the connector body, the respective contact sections are exposed at the outside of the connector body.

6. A connector device according to claim 4, wherein, in a state in which said plurality of connection terminals are set side by side in the connector body, the respective contact sections are alternately arranged in a staggered way in a side-by-side array direction of the connection terminals.

7. A connector device according to claim 4, wherein said plurality of connection terminals each have a sandwiching section configured to sandwich a connection board in a thickness direction when the connection board is inserted into the connector body, the contact section being formed on one arm section of the sandwiching section.

8. A drive unit comprising:

a printed circuit board including a circuit unit for controlling an object; and a connector device including: (i) a connector body which is attached to the printed circuit board and which has a support groove; and (ii) a connection terminal which is made of a thin plate insertable in the support groove of the connector body and which has a contact section for inspection, the contact section having a flat surface larger than the connection terminal and expanding in a thickness direction of the connection terminal.

9. A drive unit according to claim 8, wherein, in a state in which the connection terminal is set in the connector body, the contact section is exposed at the outside of the connector body.

10. A drive unit according to claim 8, wherein the connection terminal has a sandwiching section configured to sandwich the connection board in a thickness direction when the connection board is inserted into the connector body, the contact section being formed on one arm section of the sandwiching section.

11. A drive unit comprising:

a printed circuit board including a circuit unit for controlling an object; and a connector device including: (i) a connector body which is attached to the printed circuit board and which has support grooves; and (ii) connection terminals which are made of thin plates insertable in the support grooves of the connector body and which each has a contact section for inspection, the contact section having a flat surface larger than the connection terminal and expanding in a thickness direction of the connection terminal.

12. A drive unit according to claim 11, wherein, in a state in which said plurality of connection terminals are set in the connector body, the respective contact section is exposed at the outside of the connector body.

13. A drive unit according to claim 11, wherein, in a state in which said plurality of connection terminals are arranged side by side in the connector body, the respective contact sections are alternately arranged in a staggered way in a side-by-side array direction of the connection terminals.

14. A drive unit according to claim 11, wherein said plurality of connection terminals each have a sandwiching section configured to sandwich the connection board in a thickness direction when the connection board is inserted into the connector body, the contact section being formed on one arm section of the sandwiching section.

* * * * *